US010869502B2

(12) United States Patent
Fornarelli

(10) Patent No.: US 10,869,502 B2
(45) Date of Patent: Dec. 22, 2020

(54) DISPOSABLE ASSEMBLY FOR VAPORIZING E-LIQUID AND A METHOD OF USING THE SAME

(71) Applicant: AVANZATO TECHNOLOGY CORP., Chicago, IL (US)

(72) Inventor: Thomas Fornarelli, Chicago, IL (US)

(73) Assignee: 14TH ROUND INC., Los Angeles, CA (US)

( * ) Notice: Subject to any disclaimer, the term of this patent is extended or adjusted under 35 U.S.C. 154(b) by 234 days.

(21) Appl. No.: 15/225,800

(22) Filed: Aug. 1, 2016

(65) Prior Publication Data

US 2017/0027230 A1 Feb. 2, 2017

Related U.S. Application Data

(60) Provisional application No. 62/199,406, filed on Jul. 31, 2015.

(51) Int. Cl.
*A24F 47/00* (2020.01)
*B65D 25/02* (2006.01)

(52) U.S. Cl.
CPC ..... *A24F 47/008* (2013.01); *B65D 25/02* (2013.01)

(58) Field of Classification Search
CPC ..... A24F 47/008; B65D 25/02
USPC ..... 392/390
See application file for complete search history.

(56) References Cited

U.S. PATENT DOCUMENTS 3,425,414 A * 2/1969 La Roche ..... A61M 11/02 128/203.21
4,110,419 A * 8/1978 Miller ..... A61M 16/162 128/203.27
4,171,000 A * 10/1979 Uhle ..... A61M 15/06 131/273
4,178,334 A * 12/1979 Miller ..... A61M 11/06 128/200.21
4,529,867 A * 7/1985 Velnosky ..... A61M 16/168 137/391
4,535,622 A * 8/1985 Yeoman ..... B01D 47/00 73/61.62
4,878,832 A * 11/1989 Lynch ..... F21S 13/00 431/120
4,923,052 A * 5/1990 Englebert ..... F16N 31/006 184/1.5
5,053,603 A * 10/1991 Wagner ..... F01N 3/027 219/205
5,101,095 A * 3/1992 Wagner ..... F01N 3/027 123/549
5,325,765 A * 7/1994 Sylvan ..... A47J 31/0673 426/433

(Continued)

*Primary Examiner* — Eric S Stapleton
(74) *Attorney, Agent, or Firm* — Flener IP & Business Law; Zareefa B. Flener

(57) ABSTRACT

A disposable assembly and method for providing a liquid chemical for administration which is disposable. The disposable assembly including a tank having an airflow chamber and a liquid chamber, a vaporizer having a first end, a second end, and a movable ring. The first end of the vaporizer is operable to removably attach to the tank. The second end of the vaporizer is operable to removably attach to a battery. Attaching the battery to the second end of the vaporizer actuates the movable ring, and actuating the movable ring introduces air into the liquid chamber of the tank.

15 Claims, 7 Drawing Sheets

(56) References Cited

U.S. PATENT DOCUMENTS 5,357,271 A * 10/1994 Wiklof ..... B41J 2/33585 347/197
5,404,890 A * 4/1995 Gentry ..... A24D 3/04 131/342
5,417,258 A * 5/1995 Privas ..... B05B 11/0013 141/18
6,031,969 A * 2/2000 Burr ..... A47L 1/08 15/320
6,065,957 A * 5/2000 Kondo ..... F23C 9/00 431/116
6,250,301 B1 * 6/2001 Pate ..... A61M 11/041 128/202.21
6,786,136 B2 * 9/2004 Cirigliano ..... A47J 31/0642 426/433
7,185,648 B1 * 3/2007 Rand ..... A61M 15/009 128/200.23
7,748,379 B2 * 7/2010 Rasor ..... A61H 33/14 128/200.24
8,701,549 B2 * 4/2014 Mordini ..... A47J 31/0615 99/304
8,794,231 B2 * 8/2014 Thorens ..... A24F 47/008 128/202.21
8,813,633 B2 * 8/2014 Ricotti ..... A47J 31/0642 99/275
8,869,793 B1 * 10/2014 Spandorfer ..... A61B 5/082 128/202.27
9,038,626 B2 * 5/2015 Yamada ..... A61M 11/041 128/200.21
9,050,431 B2 * 6/2015 Turner ..... A61M 15/009
9,095,236 B2 * 8/2015 Perentes ..... A47J 31/3695
9,271,598 B2 * 3/2016 Yoakim ..... A47J 31/22
9,345,269 B2 * 5/2016 Liu ..... A24F 47/008
9,380,811 B2 * 7/2016 Chung ..... A24F 1/30
9,380,812 B2 * 7/2016 Chung ..... A24F 47/008
9,510,705 B2 * 12/2016 Rolfes ..... A47J 31/38
9,545,489 B2 * 1/2017 Turner ..... A61M 15/009
9,681,688 B1 * 6/2017 Rinehart ..... A61M 15/06
9,723,872 B2 * 8/2017 Liu ..... A24F 47/008
9,918,495 B2 * 3/2018 DePiano ..... A24F 47/008
10,071,851 B2 * 9/2018 Vu ..... A47J 31/0689
10,117,460 B2 * 11/2018 Sears ..... A24F 47/008
10,154,751 B2 * 12/2018 DeMiglio ..... A47J 31/0689
2001/0004934 A1 * 6/2001 Yamamoto ..... F28D 15/0233 165/104.11
2002/0139867 A1 * 10/2002 Bulloch ..... B01F 3/12 239/318
2003/0064340 A1 * 4/2003 Pappas ..... C11C 5/006 431/298
2003/0070554 A1 * 4/2003 Cortese ..... A47J 31/3628 99/279
2003/0108743 A1 * 6/2003 Anderson ..... A01N 25/26 428/402.24
2005/0016550 A1 * 1/2005 Katase ..... A24F 47/002 131/194
2006/0049738 A1 * 3/2006 Tabata ..... C01B 13/11 313/362.1
2006/0219552 A1 * 10/2006 Sasaki ..... G01N 33/006 204/424
2007/0144514 A1 * 6/2007 Yeates ..... A61M 15/0086 128/203.15
2008/0283153 A1 * 11/2008 Zurecki ..... H05H 1/48 148/217
2009/0095311 A1 * 4/2009 Han ..... A24F 47/008 131/194
2009/0324206 A1 * 12/2009 Young ..... F04B 17/00 392/395
2010/0003904 A1 * 1/2010 Duescher ..... B24B 37/14 451/259
2010/0018524 A1 * 1/2010 Jinks ..... A61M 15/009 128/200.23
2010/0064899 A1 * 3/2010 Aardenburg ..... A47J 31/3633 99/295
2010/0199983 A1 * 8/2010 Jinks ..... A61M 15/009 128/200.23
2010/0211011 A1 * 8/2010 Haar ..... A61M 5/14248 604/151
2010/0263548 A1 * 10/2010 Kokatsu ..... A47J 31/02 99/306
2011/0073121 A1 * 3/2011 Levin ..... A24F 1/32 131/328
2011/0094523 A1 * 4/2011 Thorens ..... A24F 47/008 131/194
2011/0226236 A1 * 9/2011 Buchberger ..... A61M 11/041 128/200.23
2011/0290248 A1 * 12/2011 Schennum ..... A24F 47/002 128/202.21
2011/0303231 A1 * 12/2011 Li ..... A24F 47/008 131/329
2012/0000478 A1 * 1/2012 Wagenhals ..... A24F 13/04 131/329
2012/0097532 A1 * 4/2012 DeLuze ..... G21B 3/006 204/278
2012/0180994 A1 * 7/2012 Yang ..... F28D 15/046 165/104.26
2012/0180995 A1 * 7/2012 Yang ..... F28D 15/046 165/104.26
2012/0199572 A1 * 8/2012 Shen ..... A61M 11/041 219/438
2012/0255546 A1 * 10/2012 Goetz ..... A61M 11/041 128/202.21
2012/0279512 A1 * 11/2012 Hon ..... A24F 47/008 131/329
2013/0014772 A1 * 1/2013 Liu ..... A24F 47/008 131/329
2013/0017303 A1 * 1/2013 Vu ..... A47J 31/0689 426/433
2013/0081623 A1 * 4/2013 Buchberger ..... A61M 11/041 128/203.27
2013/0081642 A1 * 4/2013 Safari ..... A24F 47/008 131/329
2013/0112214 A1 * 5/2013 Bundren ..... D02G 1/00 131/280
2013/0142918 A1 * 6/2013 Ye ..... A47J 31/3623 426/126
2013/0160765 A1 * 6/2013 Liu ..... A24F 47/008 128/202.21
2013/0192618 A1 * 8/2013 Li ..... A24F 47/008 131/329
2013/0192620 A1 * 8/2013 Tucker ..... H01C 17/00 131/329
2013/0192623 A1 * 8/2013 Tucker ..... H01C 17/00 131/329
2013/0220316 A1 * 8/2013 Oglesby ..... A24F 47/006 128/202.21
2013/0228191 A1 * 9/2013 Newton ..... A24F 47/008 131/329
2013/0247910 A1 * 9/2013 Postma ..... A61M 11/041 128/203.26
2013/0298905 A1 * 11/2013 Levin ..... A24F 47/008 128/202.21
2014/0041655 A1 * 2/2014 Barron ..... A61M 11/042 128/202.21
2014/0053831 A1 * 2/2014 Leamon ..... B05B 7/045 128/200.23
2014/0060554 A1 * 3/2014 Collett ..... H05B 3/265 131/328
2014/0069424 A1 * 3/2014 Poston ..... A24F 47/008 128/202.21
2014/0166027 A1 * 6/2014 Fuisz ..... A24F 47/002 131/328
2014/0182611 A1 * 7/2014 Liu ..... A24F 47/008 131/329
2014/0209109 A1 * 7/2014 Larson ..... A61K 9/007 131/329
2014/0238422 A1 * 8/2014 Plunkett ..... A24F 47/008 131/328
2014/0261408 A1 * 9/2014 DePiano ..... A24F 47/008 128/202.21

(56) References Cited

U.S. PATENT DOCUMENTS

2014/0261495 A1* 9/2014 Novak, III ..... A24F 47/008 131/329
2014/0270729 A1* 9/2014 DePiano ..... A24F 47/008 392/397
2014/0270730 A1* 9/2014 DePiano ..... A24F 47/008 392/404
2014/0283946 A1* 9/2014 Kribs ..... B65D 47/06 141/2
2014/0299140 A1* 10/2014 Liu ..... A24F 47/008 131/329
2014/0305431 A1* 10/2014 Holley ..... A61M 16/085 128/201.13
2014/0334802 A1* 11/2014 Dubief ..... A61L 9/03 392/390
2014/0360514 A1* 12/2014 Zhu ..... A24F 47/008 131/329
2014/0360517 A1* 12/2014 Taggart ..... A24F 47/008 131/329
2015/0007836 A1* 1/2015 Li ..... A24F 47/008 131/329
2015/0040929 A1* 2/2015 Hon ..... A24F 47/008 131/329
2015/0047661 A1* 2/2015 Blackley ..... H05B 3/12 131/329
2015/0053217 A1* 2/2015 Steingraber ..... A24F 47/008 131/329
2015/0059787 A1* 3/2015 Qiu ..... H05B 3/14 131/329
2015/0122252 A1* 5/2015 Frija ..... A24F 47/008 128/202.21
2015/0122275 A1* 5/2015 Wu ..... A24F 1/30 131/329
2015/0136158 A1* 5/2015 Stevens ..... A24F 47/008 131/329
2015/0150307 A1* 6/2015 Liu ..... H05B 1/0244 131/329
2015/0157053 A1* 6/2015 Mayor ..... A24F 47/008 131/329
2015/0164147 A1* 6/2015 Verleur ..... A24F 47/008 131/329
2015/0181945 A1* 7/2015 Tremblay ..... A24F 47/008 131/328
2015/0196060 A1* 7/2015 Wensley ..... F22B 1/288 392/390
2015/0216234 A1* 8/2015 Chung ..... A24F 47/008 131/329
2015/0257444 A1* 9/2015 Chung ..... A24F 47/008 131/329
2015/0257446 A1* 9/2015 Chung ..... A24F 47/008 131/329
2015/0272225 A1* 10/2015 Worm ..... A24F 47/008 131/328
2015/0282528 A1* 10/2015 Liu ..... A61M 15/06 131/329
2015/0305407 A1* 10/2015 Li ..... A61M 11/08 131/273
2015/0342258 A1* 12/2015 Chen ..... H05B 3/06 131/329
2015/0342259 A1* 12/2015 Baker ..... A24F 47/008 131/329
2015/0374039 A1* 12/2015 Zhu ..... A24F 47/008 131/329
2016/0007654 A1* 1/2016 Zhu ..... A24F 47/008 131/328
2016/0121058 A1* 5/2016 Chen ..... A61M 11/04 128/200.19
2016/0128384 A1* 5/2016 Luciani ..... A24F 47/008 131/329
2016/0157522 A1* 6/2016 Zhu ..... A24F 47/008 131/329
2016/0286860 A1* 10/2016 Flayler ..... A24F 47/008
2016/0360786 A1* 12/2016 Bellinger ..... A24F 47/008
2017/0013878 A1* 1/2017 Schuler ..... H05B 1/0244

* cited by examiner

DISPOSABLE ASSEMBLY FOR VAPORIZING E-LIQUID AND A METHOD OF USING THE SAME

FIELD OF THE INVENTION

The present invention relates to a disposable assembly for vaporizing e-liquid and a method of using the same. More specifically, the invention relates to a disposable assembly and method of using the disposable assembly in smokeless administration of chemicals via vaporization, wherein the disposable assembly can be adapted to currently existing batteries.

BACKGROUND

Marijuana plant varieties (*Cannabis setiva, Cannabis indica, Cannabis rederalis*, etc.) contain a variety of compounds, the major psychoactive compound being tetrahydrocannabinol (THC). Other compounds are also present, including cannabidiol (CBD), which is less psychoactive and believed to have a broader range of medical applications. These other types of chemicals, and a mixture of the same are more often being utilized in medically effective, and in some situations in recreational, ways.

When inhaling combustion byproducts, users cannot regulate the percentages of individual chemicals, such as cannabinoids, which enter the lungs. Additionally, undesirable side effects are also prevalent such as irritating, potentially toxic or carcinogenic side effects when amounts are not carefully monitored. However, many recreational users prefer mimicking smoking by inhaling for personal and social reasons. Moreover, the options of pill taking or orally consumed products, though allowing for adjustment of concentrations and amounts, provides a delay in effect by travelling through the digestive system.

For this reason, systems have been developed which provide a tank having a particular volume for filling with a liquid chemical mixture, and an atomizer for the vaporization of the same. These systems, however, still have problems. The vaporizer can be jostled or be affected by barometric pressure changes thus shifting and allowing for the liquid to leak out. The cost of the liquid chemicals can be quite high. Loss of any of the chemicals through leaky tanks, or through pressure changes which loosens caps on tanks, can also therefore be quite expensive. In such situations, it is well known that the liquid produces a distinct and often unpleasant odor, which when leaked onto clothes, in bags or items, makes for an unpleasant experience for the owner, not to mention expensive. It is also inconvenient to replace a defective delivery system considering it is not yet a universally accepted recreation, and in the medical realm requires prescriptions and clinics through which to get the same. In both situations, not every state has the replacement parts or system as a whole readily available. Other systems require that the tank be filled by hand making it messy and usually results in the loss of liquid and thus an economic loss.

SUMMARY OF THE INVENTION

The invention is related to a disposable assembly for providing liquid chemicals in a vaporized state to a user, wherein the disposable assembly is easy to use by a user and maintains the internal liquid securely sealed in the tank despite jostling and barometric pressure changes.

The invention is related to a vaporizer for use with a disposable assembly. The vaporizer includes a first end and a second end with a movable ring. The first end is operable to removably attach to a tank. Actuating the movable ring introduces air into a liquid chamber of the tank.

The invention is related to a disposable assembly for liquid for smokeless administration. The disposable assembly includes a tank, a vaporizer, and a battery. The tank has an airflow chamber and a liquid chamber. The vaporizer has a first end, a second end, and a movable ring. The first end of the vaporizer is operable to removably attach to the tank. The battery is operable to removably attach to second end of the vaporizer. Attaching the battery to the second end of the vaporizer actuates the movable ring, and actuating the movable ring introduces air into the liquid chamber of the tank.

DETAILED DESCRIPTION OF THE DRAWINGS

The following detailed embodiments presented herein are for illustrative purposes. That is, these detailed embodiments are intended to be exemplary of the present invention for the purposes of providing and aiding a person skilled in the pertinent art to readily understand how to make and use of the present invention.

Accordingly, the detailed discussion herein of one or more embodiments is not intended, nor is to be construed, to limit the metes and bounds of the patent protection afforded the present invention, in which the scope of patent protection is intended to be defined by the claims and equivalents thereof. Therefore, embodiments not specifically addressed herein, such as adaptations, variations, modifications, and equivalent arrangements, should be and are considered to be implicitly disclosed by the illustrative embodiments and claims described herein and therefore fall within the scope of the present invention.

Further, it should be understood that, although steps of various claimed methods may be shown and described as being in a sequence or temporal order, the steps of any such method are not limited to being carried out in any particular sequence or order, absent an indication otherwise. That is, the claimed method steps are considered capable of being carried out in any sequential combination or permutation order while still falling within the scope of the present invention.

Additionally, it is important to note that each term used herein refers to that which a person skilled in the relevant art would understand such term to mean based on the contextual use of such term herein. To the extent that the meaning of a term used herein, as understood by the person skilled in the relevant art based on the contextual use of such term, differs in any way from any particular dictionary definition of such term, it is intended that the meaning of the term as understood by the person skilled in the relevant art should prevail.

Furthermore, a person skilled in the art of reading claimed inventions should understand that "a" and "an" each generally denotes "at least one," but does not exclude a plurality unless the contextual use dictates otherwise. And that the term "or" denotes "at least one of the items," but does not exclude a plurality of items of the list.

Figure 1:
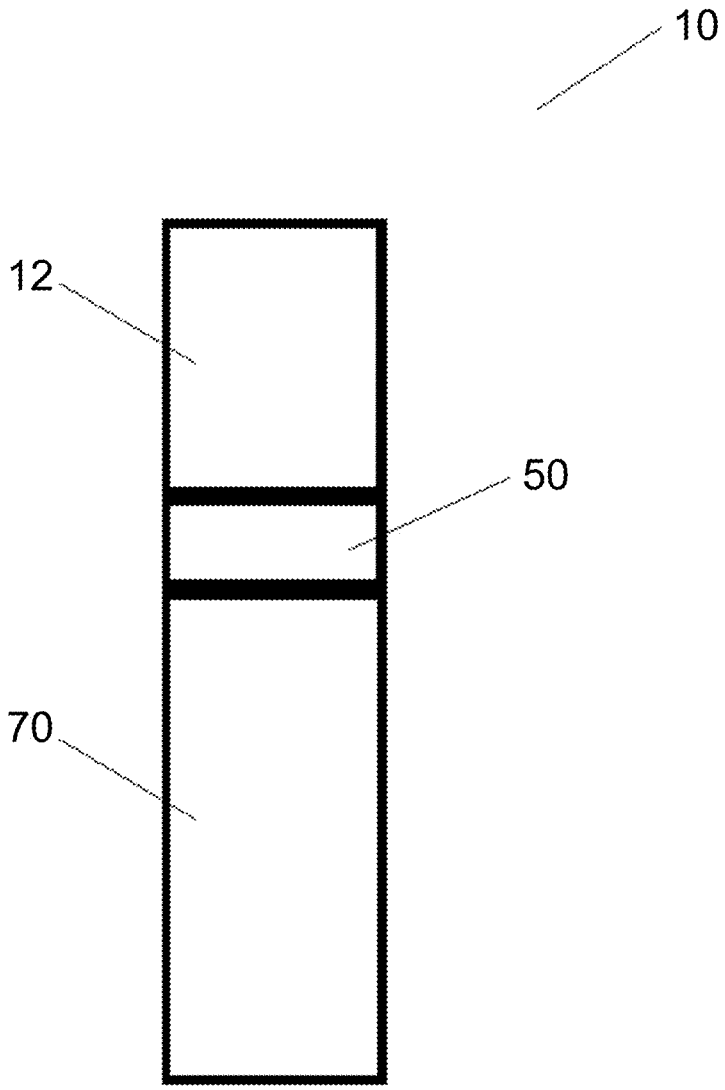
FIG. 1 illustrates an embodiment of the disposable assembly in accordance with the principles of the present invention.

FIG. 1 illustrates a disposable assembly 10 having a tank 12 and a vaporizer 50. The system 10 illustrated in FIG. 1 is assembled. To be operable, the tank 12 accommodates a mouthpiece at the end opposite the vaporizer 50, and the vaporizer 50 accommodates a battery 70 at the end opposite the tank 12, which allows the user to access the vaporized chemicals in the tank 12. The tank 12 and the vaporizer 50 assembly 10 can be of various alternative embodiments.

Figure 2:
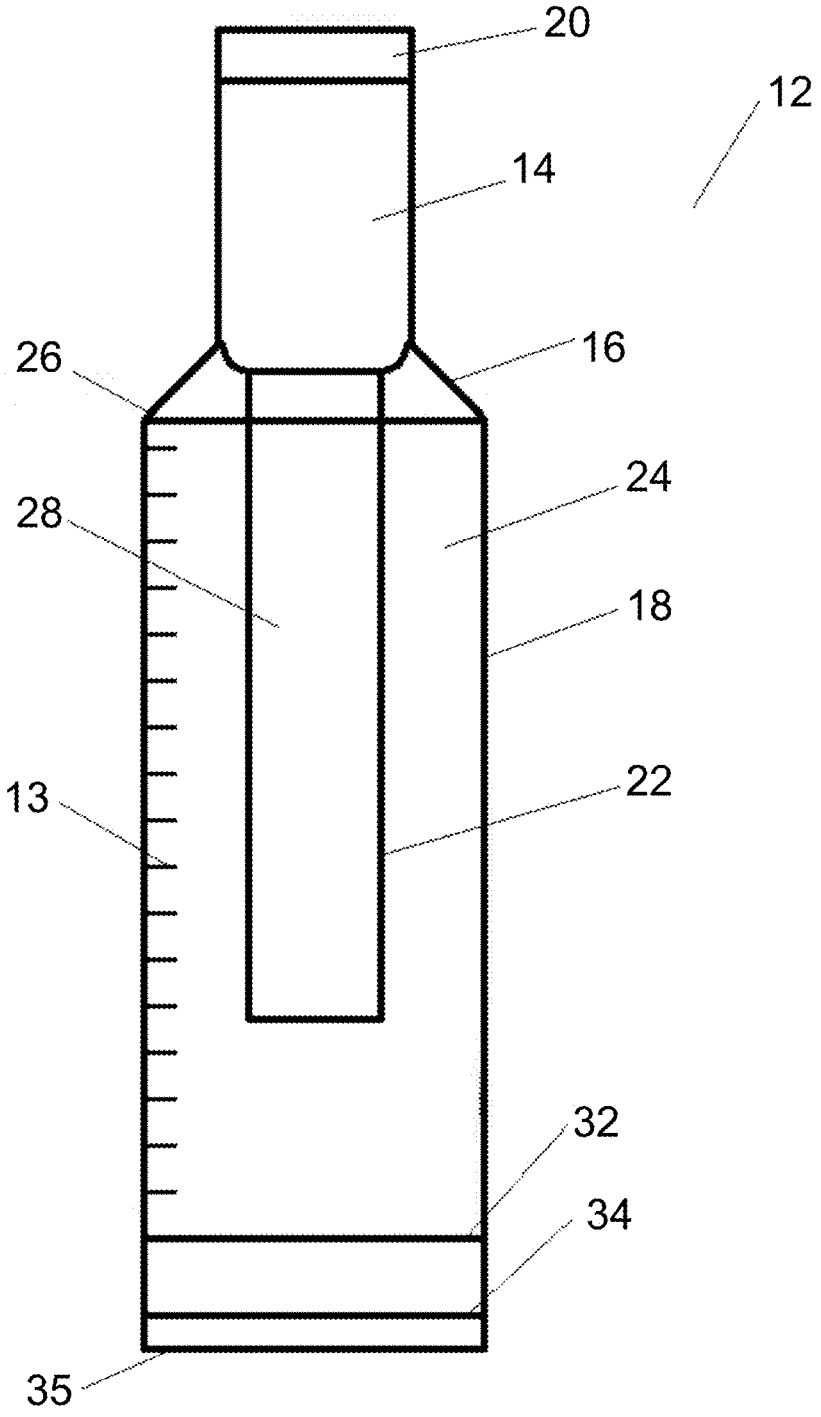
FIG. 2 illustrates an embodiment of a tank of the disposable assembly in accordance with the principles of the present invention.

FIG. 2 is an illustration of an embodiment of the tank 12 of the disposable assembly 10. The tank 12 has a first tubular portion 14 contiguous with and sharply angled into a cone portion 16, which in turn is contiguous with a second tubular portion 18 which has a wider diameter than the first 14, facilitated by the cone portion 16. The second tubular portion 18 may also be referred to as a liquid chamber wall 18. The portions 14, 16, and 18 are circular and concentric in this embodiment. Non-circular and non-concentric portions 14, 16, and 18 are also possible and are known to a person skilled in the relevant art.

The second tubular portion 18 terminates at an opening 35. When assembled, the opening 35 accommodates a vaporizer 50. Thus, the aperture 35 may also be referred to as the vaporizer end 35. A vaporizer 50 is pressed through the opening 35 until the line 32. In order to prevent movement after placement of the vaporizer into the tank 12, there is a lip and groove 34 located at the termination of the second tubular portion 18 (also referred to as the liquid chamber wall 18). This lip and groove 34 in the embodiment of FIG. 2 is shown to be located along the inside circumference of the second tubular portion 18. It is also possible that in an alternate embodiment, the lip and groove 34 is located on the outside of the vaporizer 50. In this embodiment, for the disposable assembly 10 to be securely fitted together, and to accommodate the lip and groove 34 on the tank 12, there is a corresponding groove on the external circumference of the vaporizer 50. It is not necessary that the lip and groove be located on the tank 12 while the corresponding groove be located on the vaporizer 50. In an alternate embodiment, the lip and groove could be located on the external circumference of the vaporizer 50 while the corresponding and accommodating groove 34 is located on the tank 12.

The first tubular portion 14 terminates in a circular mouthpiece end 20 at the end opposite the cone portion 16. The tank 12 is provided with a liquid chamber 24 and an airflow chamber 28. The airflow chamber 28 extends from the mouthpiece end 20 of the first tubular portion 14. The airflow chamber 28 is contiguous with the first tubular portion 14 at a joint 26 joining the cone portion 16 and the first tubular portion 14. The airflow chamber 28 is defined by an airflow chamber wall 22. The airflow chamber wall 22 may be composed of, for example, but not limited to, glass, plastic and medical grade plastic. The liquid chamber 24 can be filled with a liquid chemical while the airflow chamber 28 remains filled with air. Also shown on the embodiment in FIG. 2 is a scale 13 along the side of the tank providing a person filling the tank 12 with a gauge for progress in filling, and thus accuracy, and also for more accurately delivering the precise intended amount into the tank 12. In another embodiment of the tank 12, however, the tank 12 is not provided with a scale 13. The scale may be referred to as, for example, but not limited to, a measurement tool. This tank 12 can be used for larger quantities of liquid, and for example can be made as, but not limited to, a 14 mm tank 12.

Figure 3:
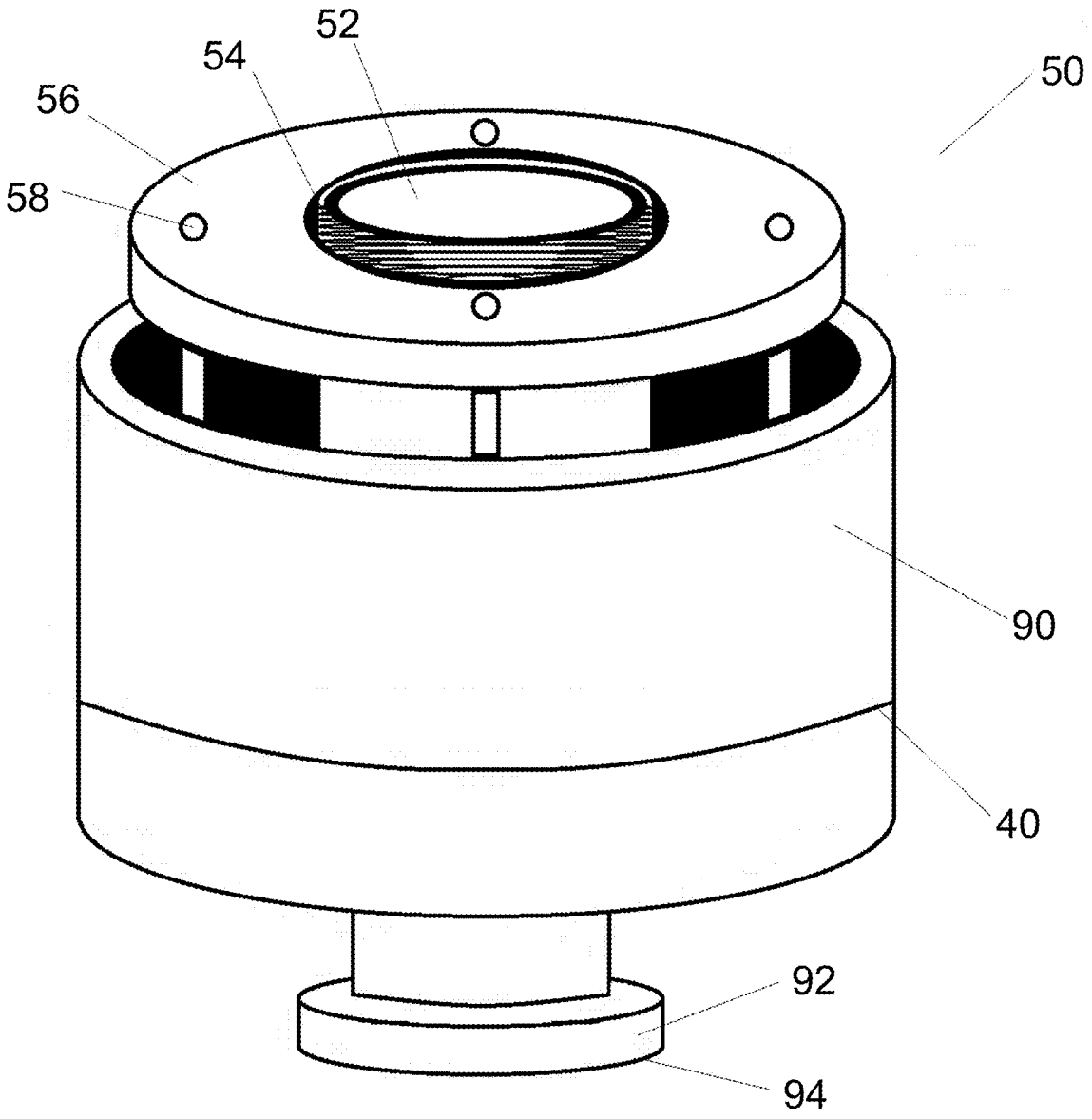
FIG. 3 illustrates an embodiment of a vaporizer of the disposable assembly in accordance with the principles of the present invention.

FIG. 3 is an illustration of an embodiment of the vaporizer 50 of the disposable assembly 10. In this embodiment, the vaporizer 50 is in a closed position. The vaporizer 50 has a central post 52 surrounded by a threaded portion 54. The threaded portion 54 is located at a first end of the vaporizer 50 that is operable to removably attach to the tank 12 at the vaporizer end 35. Surrounding the central post 52 and the threaded portion 54 is a ring 56 which has four guiding posts 58 equally positioned around the ring 56 and flush with the face of the ring 56. The central post 52, the threaded portion 54, and the ring 56 are accommodated and situated in a housing 90. The ring 56 may be, for example, but not limited to, concentric with the central post 52. The central post 52 extends through the housing 90 and terminates in a lip 92 to which an o-ring 94 is adhered. The lip 92 is located at a second end of the vaporizer that is operable to removably attach to a battery 70. The central post 52 has apertures for air passage internally (not shown in this view of the vaporizer 50) allowing air to enter the airflow chamber 28 of the tank 12. The air passes through the apertures of the central post 52, near a heating element within the housing 90 that vaporizes the liquid, and into the airflow chamber 28 of the tank. Heating elements for vaporizers 50 of disposable assemblies 10 are known to a person skilled in the relevant art.

Also provided on the vaporizer 50 is a small groove 40 around the perimeter of the housing 90. Inside the housing 90 and not visible in the closed position (but visible in the open position illustrated in FIG. 6) is a protrusion that has apertures that allow air to enter the liquid chamber 24 of the tank 12 when the ring is pushed into an open position. Allowing air to enter the liquid chamber 24 changes barometric pressure differences inside the tank 24 and reduces the chance of leakage. The barometric pressure differences are between, for example, but not limited to, the airflow chamber 28, the liquid chamber 24, the vaporizer 50, and environment outside the disposable assembly 10.

In use, the vaporizer 50 is pressed into the tank 12. In one embodiment, as in FIG. 3, the vaporizer 50 has a groove 40 that corresponds to a lip on the inside of the tank (as in the embodiment of FIG. 2). The vaporizer 50 is therefore pressed into the tank 12 so that the lip 92 having the o-ring 94 on the end is pressed against the airflow chamber wall 22 so as to seal off the air in the space 28 from the liquid residing in the space 24 of the tank 12. When the vaporizer 50 is pressed past the lip and groove on the tank 12, for example the lip and groove 34 on the tank 12 in FIG. 2, the lip and groove 34 will mate with and accommodate the groove 40 located on the housing 90 of the vaporizer 50. This secure fitting lends stability to the disposable assembly.

Figure 4:
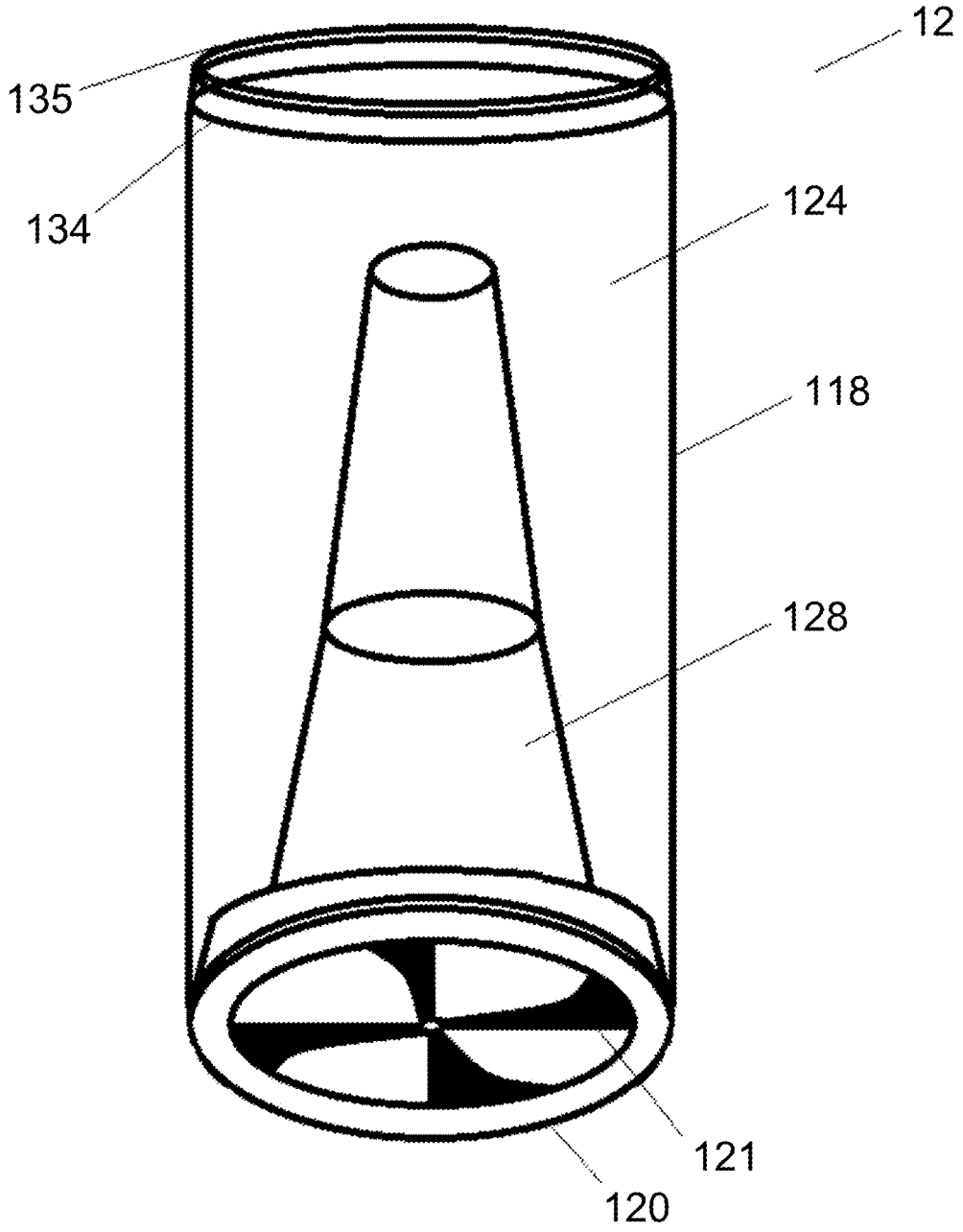
FIG. 4 illustrates another embodiment of the tank of the disposable assembly in accordance with the principles of the present invention.

FIG. 4 illustrates another embodiment of a tank 12 of the disposable assembly 10. In this embodiment, the tank 12 is provided with a mouthpiece end 120 having a vortex tip 121 for more efficient delivery of the evaporated liquid and efficient mixing of flavors. This vortex tip 121 can also be provided on any other embodiment of the tank 12, for example the one shown in FIG. 2. The tank 12 in this embodiment is tapered from the mouthpiece end 120 to the vaporizer end 135, and has the advantage of being able to enhance flavor mixing. Also seen is an airflow chamber 128 and a liquid chamber 124, both internal to the tubular portion 118. Only one tubular portion 118 is provided in this embodiment which terminates at a vaporizer end 135 opposite the mouthpiece end 120. The tubular portion 118 may be composed of, for example, but not limited to, glass. A wall defining the airflow chamber 128 may also be composed of, for example, but not limited to, glass. Moreover, to illustrate the versatility of having an o-ring on different features yet with the same goal of stabilizing the disposable assembly 10, this embodiment of the tank 12 is also provided with a groove 134 to accommodate the corresponding lip and groove 34 on the vaporizer 50 so that when mated, the groove 134 accommodates the vaporizer 50 lip and groove 34 stabilizing the disposable assembly 10 and helping to prevent dislocation of the vaporizer 50 and ultimate loss or seepage of the liquid from the tank 12.

Figure 5:
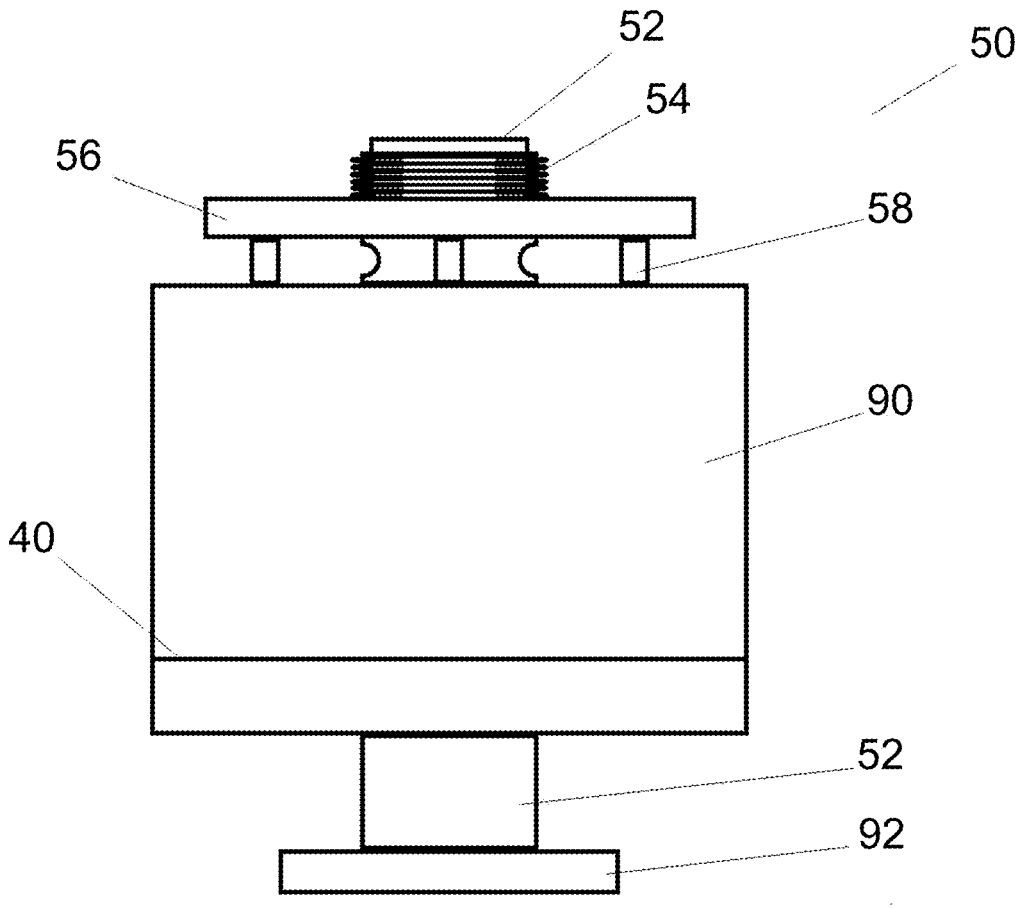
FIG. 5 illustrates an embodiment of the vaporizer of the disposable assembly in a closed position in accordance with the principles of the present invention.

The ring 56 as illustrated in the embodiment of the vaporizer 50 in FIG. 3 is movable. FIG. 5 illustrates the ring 56 of the vaporizer 50 in a closed position, located above the housing 90 surrounding and almost level with the central post 52 and the threaded portion 54. The guiding posts 58 of the ring 56 are more visible in this position when viewed from the side. When the vaporizer 50 is assembled into the tank 12, it can remain in the closed position, but when a user is ready to use the disposable assembly 10, the user will push the ring 56 along the guiding posts 58 into the housing 90 in order that air is introduced to the tank 12 by a protrusion. The protrusion is attached to the guiding posts 58 opposite the ring 56; the protrusion protrudes from the housing 90 at an end opposite the ring 56 when the ring 56 is moved into an open position (described in more detail with respect to FIG. 6).

Figure 6:
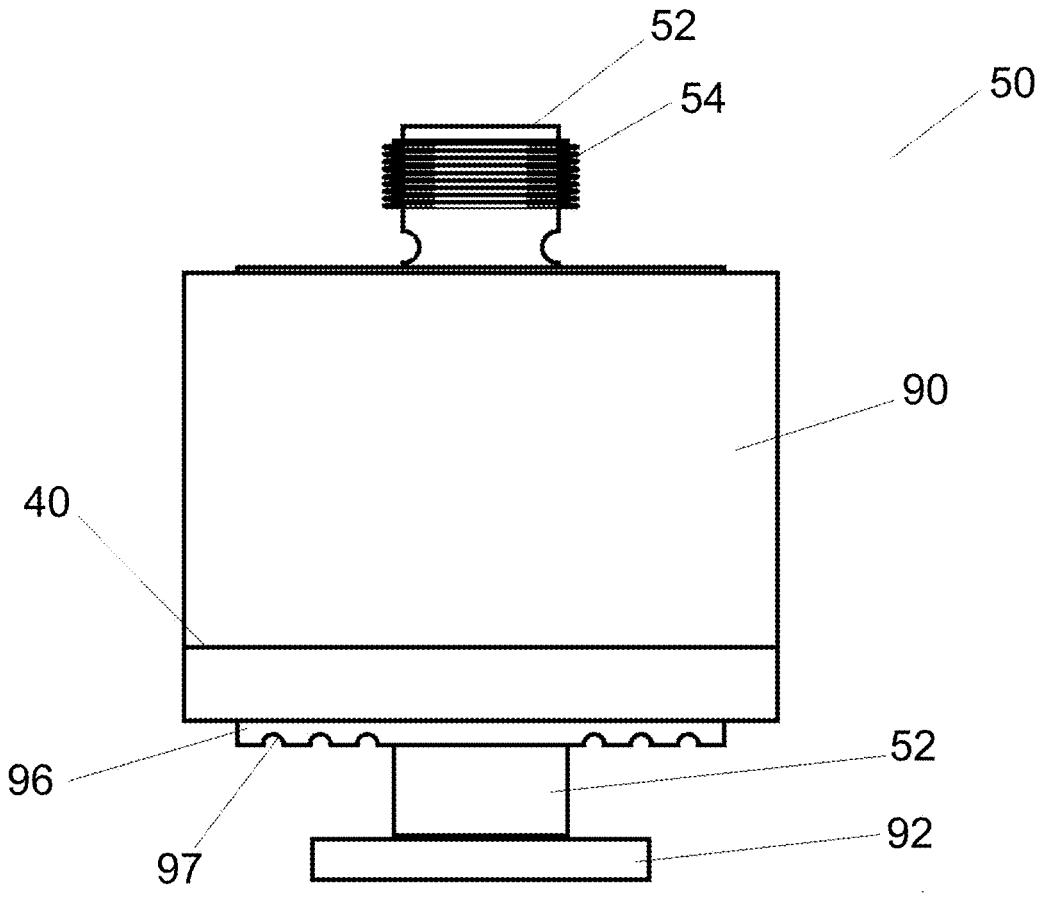
FIG. 6 illustrates an embodiment of the vaporizer of the disposable assembly in an open position in accordance with the principles of the present invention.

Introducing air into the liquid chamber 24 of the tank 12 in the open position serves two purposes; the first is that the air allows the liquid chemicals to be more effective when vaporized, and the second is that the tank 12 is able to withstand changes in barometric pressure without leaking the liquid out of the tank 12. FIG. 6 illustrates the vaporizer 50 in the open position. Introducing air into the liquid chamber 24 of the tank 12 may also be referred to as, for example, but not limited to, ventilating, aerating, circulating, or exposing the liquid in the liquid chamber 24.

FIG. 6 illustrates the vaporizer 50 in an open position. The ring 56 is configured to be pushed by the users fingers and remains in place in the open position after it has been pushed in. The open position of the ring 56 may be, for example, but not limited to, flush with the housing 90. In addition, however, the internal portion of the housing 90 can have an o-ring and groove, or a catch, or a groove, or any other feature which could be configured to mate with the end of the guiding posts 58 opposite the ring 56 end, so that the ends of the guiding posts 58 are captured by the feature in order to secure the ring 56 in place in the open position. One embodiment of the feature securing the guiding posts 58 in the open position includes four lock washers, one for each of the guiding posts 58. When the guiding posts 58 are pushed through the housing from the closed to the open position, each guiding post 58 is received through a lock washer which prevents the backwards movement of the guiding post 58 once pushed through. This prevents each guiding post 58 from moving, and thus retains the ring in the open position. In such an embodiment, the lock washers are housed inside the housing 90 and are not, therefore, visible from the outside of the assembly 10.

Attached to the guiding posts 58 and opposite the ring 56 is a protrusion 96. The protrusion 96 extends beyond the housing 90 and into the liquid chamber 24 of the tank 12 when the ring 56 is in the open position. The central post 52 extends through the housing and terminates in a lip 92. The vaporizer 50 is pressed into the tank 12 so that the lip 92 is pressed against the airflow chamber wall 22 so as to seal off the air in the airflow chamber 28 from the liquid residing in the liquid chamber 24 of the tank 12. The protrusion 96 has a plurality of apertures 97 for air passage allowing air to enter the liquid chamber 24 of the tank 12. Allowing air to enter the liquid chamber 24 changes barometric pressure differences inside the tank 12 and reduces the chance of leakage of liquid. The barometric pressure differences are between, for example, but not limited to, the airflow chamber 28, the liquid chamber 24, the vaporizer 50, and environment outside the disposable assembly 10.

The plurality of apertures 97 of the protrusion 96 may be arranged in symmetrical, mirror symmetrical, rotational symmetrical, linear rows and columns, tiling, or any additional patter or combination thereof. Each of the plurality of apertures 97 of the protrusion 96 may be in the shape of a circle, oval, rectangle, triangle, polygon, or any geometric shape of combination thereof. A dimension—for example, but not limited to, the diameter, the side length, or the height—of each of the plurality of apertures 97 of the protrusion 96 may be, for example, but not limited to, more than 0.1 mm and less than 2 cm. Other arrangements, shapes, and sizes of the plurality of apertures 97 of the protrusion 96 are possible and known to a person skilled in the relevant art.

The plurality of apertures 97 of the protrusion 96 introduce air into the liquid chamber 24 of the tank 12. The air introduced into the liquid chamber 24 may be drawn from, for example, but not limited to, an opening on the housing 90 of the vaporizer 50, an opening on the central portion 52 of the vaporizer 50, or an opening on the battery 70 of the disposable assembly 10. The air passes through the housing 90 of the vaporizer. Liquid from the liquid chamber 24 of the tank 12 is not able to pass through the plurality of apertures 97 of the protrusion 96 into the housing 90 of the vaporizer 50.

Figure 7:
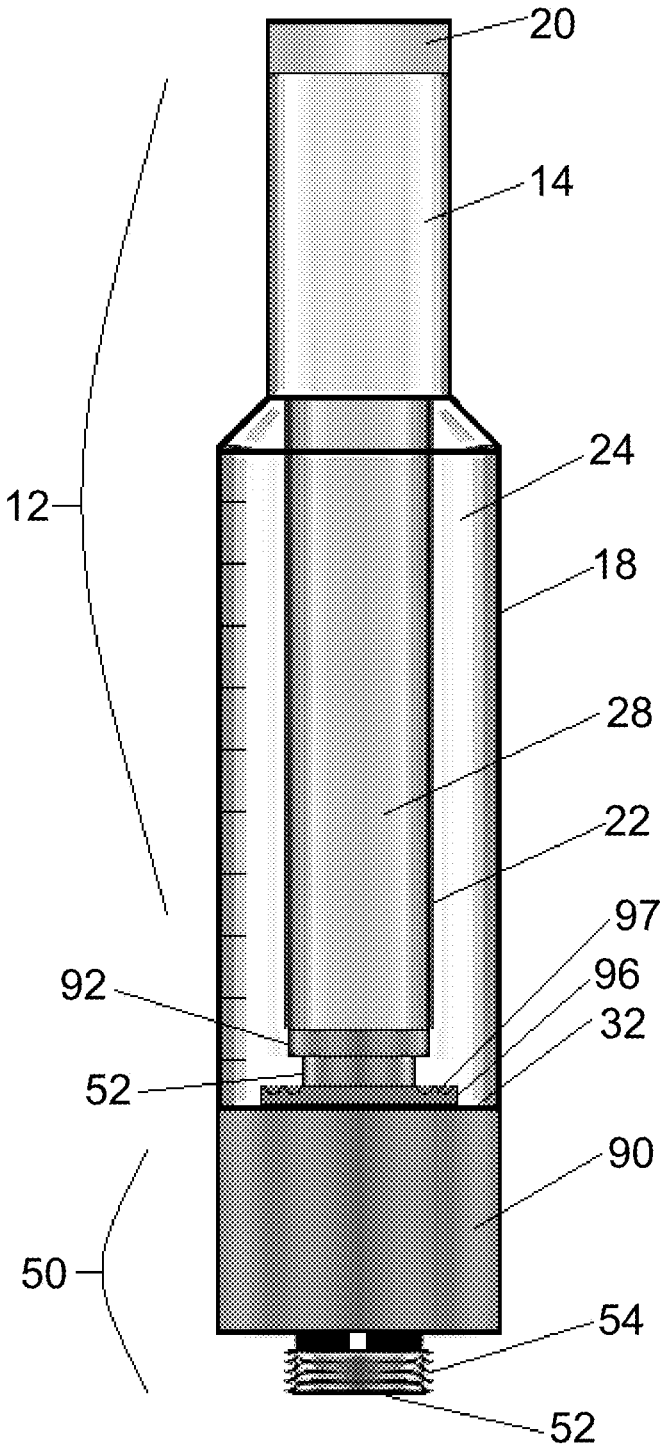
FIG. 7 illustrates an embodiment of the vaporizer of the disposable assembly in the open position and attached to the tank of the disposable assembly in accordance with the principles of the present invention.

FIG. 7 illustrates an embodiment of the vaporizer 50 of the disposable assembly 10 in the open position (previously described with respect to FIG. 6) and attached to the tank 12 (previously described with respect to FIG. 2) of the disposable assembly 10. The tank 12 has a first tubular portion 14 that is contiguous with a second tubular portion 18 (also referred to as a liquid chamber wall 18). The tank 12 is provided with a liquid chamber 24 and an airflow chamber 28. The airflow chamber 28 is contiguous with the first tubular portion 14. The liquid chamber 28 can be filled with a liquid chemical. The airflow chamber 24 remains filled with air. A liquid chamber wall 18 defines the liquid chamber 24 and may be composed of, for example, but not limited to, glass. An airflow chamber wall 22 defines the airflow chamber 28 and may be composed of, for example, but not limited to, glass.

The second tubular portion 18 has a line 32 near the vaporizer end of the tank 12. The vaporizer 50 attaches to the tank 12 and is pressed into the tank 12 until I the line 32. The lip and groove 34 of the tank 12 in the embodiment of FIG. 2 and corresponding groove 40 of the vaporizer 50 in the embodiments of FIGS. 3, 5, and 6 are securely fitted together. When the lip and groove 34 and groove 40 are securely fitted together, the lip 92 of the vaporizer 50 is attached to the airflow chamber wall 22 of the tank 12 by an o-ring. The lip 92 is located at a first end of the central post 52. The second end of the central post 52 includes a threaded portion 54. The threaded portion 54 is able to receive a battery 70 (illustrated in FIG. 1).

The vaporizer 50 illustrated in FIG. 7 is in the open position. The ring 56 has been actuated into the housing 90. The guide posts 58—attached to both the ring 56 (illustrated in FIGS. 3 and 5) and the protrusion 96—have moved the protrusion 96 into the liquid chamber 24 of the tank 12. The plurality of apertures 97 of the protrusion 96 (described with respect to FIG. 6) introduce air into the liquid chamber 24. The embodiment of the tank 12 in FIG. 4 can be used in smaller assemblies 10 wherein, for example, the tank 12 can be, but is not limited to, around 9.5 mm. Moreover, in such a small assembly 10, the related vaporizer 50 would also be of a smaller diameter in its entirety thus necessitating a smaller ring 56. The ring 56 for smaller tanks 12 may be difficult for a user to press from the closed position (illustrated in FIG. 5) into the open position (illustrated in FIG. 6) due to the smaller dimensions of the small ring 56. Therefore, a battery 70 which screws onto the threaded portion 54 could be configured to, when screwed along the threaded portion 54, push the ring 56 into the open position, locking the ring 56 into place. Upon having the battery 70 becoming completely screwed along the threaded portion 54 of the central post 52, the protrusion 96 will enter the liquid chamber 24 of the tank 12 and the plurality of apertures 97 will introduce air into the liquid chamber 24.

It is understood that many users of the disposable assembly 10 have a battery 70 which is regularly used with these disposable assemblies 10 including a filled tank 12 and a vaporizer 50. However, since the smaller tank 12, as illustrated in FIG. 4, requires a battery 70 which can screw onto the threaded portion 54, while at the same time pushing the ring 56 into the open position for use, an adaptor may also be provided which can on the one end be affixed to the battery 70, and wherein the second end is configured to mate with the threaded portion 54 of the vaporizer 50. In this way, the disposable assembly 10 can also be adapted to be used with currently existing batteries 70. Although the assembly 10 has been described with reference to vaporizing liquid chemicals including such chemicals from the marijuana plant varieties, in another embodiment, the chemicals in the liquid used in the assembly could also be related to tobacco products or other liquid chemicals.

As to the manner of usage and operation of the present invention, the same should be apparent from the above description. Accordingly, no further discussion relating to the manner of usage and operation will be provided.

While a preferred embodiment of the system has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications that fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vaporizer for use with a disposable assembly, the vaporizer comprising:

a first end of the vaporizer operable to removably attach to a first end of a tank having a liquid chamber therein; and a second end of the vaporizer comprising a movable ring; wherein the movable ring is attached to a plurality of guide posts; wherein the plurality of guide posts is attached to a protrusion extendable from the first end of the vaporizer; wherein the protrusion includes a plurality of apertures disposed therethrough; and wherein actuating the movable ring operates to push the protrusion into the liquid chamber of the tank to introduce air through the plurality of apertures into the liquid chamber of the tank.

2. The vaporizer of claim 1, further comprising a groove at the first end of the vaporizer operable to receive a lip and groove of the tank.

3. The vaporizer of claim 1, wherein the movable ring is actuated by a user of the vaporizer.

4. The vaporizer of claim 1, wherein the movable ring is actuated by a battery operable to removably attach to the vaporizer at the second end of the vaporizer.

5. The vaporizer of claim 4, further comprising a central post with a threaded portion at the second end of the vaporizer, wherein the threaded portion receives the battery.

6. The vaporizer of claim 1, wherein each of the plurality of guide posts is received by a lock washer which prevents backward movement of the guide post after the movable ring is actuated.

7. A disposable assembly for liquid for smokeless administration comprising:

a tank comprising a liquid chamber; and a vaporizer comprising a first end and a second end, wherein the second end comprises a movable ring; wherein the first end of the vaporizer is operable to removably attach to the tank;

the second end of the vaporizer is operable to removably attach a battery; wherein a protrusion having a plurality of apertures disposed therethrough and operable to introduce air into the liquid chamber of the tank is disposed at the first end of the vaporizer and attached to the movable ring; and wherein actuating the movable ring pushes the protrusion into the liquid chamber of the tank.

8. The disposable assembly as in claim 7 wherein attaching the battery to the second end of the vaporizer actuates the movable ring.

9. The disposable assembly as in claim 7 wherein the movable ring can be actuated by a user and thereafter the second end of the vaporizer can be assembled with a battery.

10. The disposable assembly of claim 7, further comprising a central post with a threaded portion at the second end of the vaporizer, wherein the threaded portion receives the battery.

11. The disposable assembly of claim 10, wherein the movable ring is concentric to the central post of the second end of the vaporizer.

12. The disposable assembly of claim 7, wherein the movable ring is attached to the protrusion by a plurality of guide posts.

13. The disposable assembly of claim 12, wherein each of the plurality of guide posts is received by a lock washer which prevents backward movement of the guide post after the movable ring is actuated.

14. The disposable assembly of claim 7, further comprising a scale on the tank operable to help a user determine an amount of liquid in the liquid chamber.

15. The disposable assembly of claim 7, wherein the liquid chamber is composed of glass.

* * * * *